US006827993B2

(12) United States Patent
Horiuchi

(10) Patent No.: US 6,827,993 B2
(45) Date of Patent: Dec. 7, 2004

(54) RECORDING MATERIAL

(75) Inventor: Hiroyuki Horiuchi, Saitama (JP)

(73) Assignee: Nisshinbo Industries, Inc., Tokyo (JP)

( * ) Notice: Subject to any disclaimer, the term of this patent is extended or adjusted under 35 U.S.C. 154(b) by 65 days.

(21) Appl. No.: 09/808,130

(22) Filed: Mar. 15, 2001

(65) Prior Publication Data

US 2001/0040593 A1 Nov. 15, 2001

(30) Foreign Application Priority Data

Mar. 23, 2000 (JP) ..... 2000-081925

(51) Int. Cl.[7] ..... B41M 5/30

(52) U.S. Cl. ..... 428/32.39; 428/32.5; 428/32.51; 428/32.52

(58) Field of Search ..... 428/32.39, 32.5, 428/32.51, 32.52, 195; 430/9; 503/227; 427/361

(56) References Cited

U.S. PATENT DOCUMENTS 5,593,940 A * 1/1997 Umise et al. ..... 428/195
5,712,026 A * 1/1998 Amagai et al. ..... 427/152
6,261,670 B1 * 7/2001 Hakomori et al. ..... 427/146

* cited by examiner

*Primary Examiner*—Bruce Hess
(74) *Attorney, Agent, or Firm*—Duane Morris LLP

(57) ABSTRACT

The present invention discloses a recording material in which an ink receiving layer containing at least a resin and a pigment is provided on a substrate, the recording material being characterized in that the ink receiving layer is porous, apparent density thereof is 0.2 to 0.8 g/cm$^3$ and heat conductivity of the ink receiving layer and the substrate is 0.1 to 0.25 W/m·K. The recording material can produce highly precise image even if the amount of heat generated at the head is small and the printing pressure is low, i.e., the recording material has excellent dot reproduction and excellent dot transfer of highlighted portions.

6 Claims, No Drawings

RECORDING MATERIAL

BACKGROUND OF THE INVENTION

1. Field of the Invention

The present invention relates to a recording material which is useful when used for thermal transfer printing, especially for melting type thermal transfer printing.

2. Description of the Relates Art

Examples of the conventional recording methods include melting type thermal transfer, sublimation type thermal transfer, electrophotography, inkjet printing and the like. Among these methods, the melting type thermal transfer method is especially getting attention because the method may allow significantly small size of a device due to its small consumption of energy and also has excellent storage property due to its use of pigment ink.

The qualities which a recording material (image receiving paper) for the melting type thermal transfer is required to possess are as follows:

(1) The dot reproduction of highlighted portions is satisfactory.

(2) The clearness and the concentration of developed colors of image are excellent.

(3) The tone reproduction is satisfactory and image is smooth.

(4) The recording material and image thereon are water proof and no change is caused even if the image or the material catches moisture.

(5) The recording material and image thereon are light resistant and no fading of colors occurs in the image even if the image is left indoor or outdoor in a bright condition.

Various techniques for improvement have been developed in order to satisfy the qualities described above.

In recent years, as the use of digital steel cameras, digital video cameras and the like is increasing common, there has been generated a strong demand for instantly obtaining images of as high quality as silver salt photos. Therefore, the image quality of a printer is now intensely being improved so as to have higher precision.

For example, Japanese Patent Application Laid-Open No. 8-90944 proposes a recording material (image receiving paper) which is excellent in high precision dot reproduction and is applicable to the melting type thermal transfer, as well. In the recording material according to this proposal, the ink receiving layer formed in the substrate surface is provided as a macromolecular porous layer, the density and pore diameter of pores of the porous layer is specified and the pores are formed continuous with each other rather than independent from each other, so that the high precision reproduction is excellently achieved.

However, in recent years, printers are being improved so as to have a more compact size and be energy efficient in consideration of good portability thereof. As a result, recent printers are facing a problem of a smaller amount of heat generated at the head and a smaller printing pressure, which could cause poor ink fixing and dot reproduction. As the recording material of the invention according to aforementioned proposal has not been developed in consideration of the use in such a printer of recent type, the recording material cannot achieve satisfactory image quality when used in a printer of the recent type.

In the case of the conventional, common recording materials including the recording material of the invention according to the aforementioned proposal, even if the surface of the recording material is somewhat rough, highly precise printing is still possible as long as the amount of heat generated at the head is relatively large and the printing pressure is relatively high. However, when the amount of heat generated at the head is relatively small and the printing pressure is relatively low, there arises a problem that the dot reproduction is poor and the transfer property of dots of highlighted portions, in particular, is badly affected.

SUMMARY OF THE INVENTION

Accordingly, in consideration of the aforementioned problems associated with the conventional recording material used for the melting type thermal transfer method, the present invention has an object of providing a recording material which can cope with highly precise image even if the amount of heat generated at the head is small and the printing pressure is low, i.e., a recording material having excellent dot reproduction and excellent dot transfer of highlighted portions.

In order to achieve the object, in a first aspect of the present invention, a recording material in which an ink receiving layer containing at least a resin and a pigment is provided on a substrate is characterized in that the ink receiving layer is porous, apparent density thereof is 0.2 to 0.8 g/cm$^3$ and heat conductivity of the ink receiving layer and the substrate is 0.1 to 0.25 W/m·K.

In a second aspect of the present invention, the recording material in which an ink receiving layer containing at least a resin and a pigment is provided on a substrate is characterized in that the ink receiving layer is porous, apparent density thereof is 0.2 to 0.8 g/cm$^3$ and center line average roughness of the ink receiving layer surface is 0.20 to 0.45 $\mu$m.

In the recording material of the first aspect of the present invention, the center line average roughness of the ink receiving layer surface may be set within the range of 0.20 to 0.45 $\mu$m. Further, in the recording material of the first or the second aspect, the recording material may have a structure in which the average pore diameter of the ink receiving layer surface is 0.05 to 1 $\mu$m, or a structure in which statical coefficient of friction observed between the ink receiving layer surface and the recording material back surface is 0.1 to 0.7, dynamical coefficient of friction observed between the same two surfaces is 0.1 to 0.6 and the stiffness of the recording material in the longitudinal direction thereof is 40 to 300 cm$^3$ when measured according to JIS P 8143. Yet further, the ink receiving layer of the recording material of the first or the second aspect of the present invention may be formed by the steps of: dissolving the resin in a solvent and coating the dissolved resin on the substrate; then immersing the substrate in a liquid to which the solvent is soluble but the resin is insoluble, to allow the resin coating to solidify; and drying the product.

In short, the recording material of the present invention includes a substrate and a porous ink receiving layer formed at least one surface of the substrate. By maintaining the apparent density of the ink receiving layer at an adequate level and decreasing the heat conductivity or decreasing the center line average roughness of the ink receiving layer surface, and further by setting the average pore diameter of the ink receiving layer surface at an appropriate size, the dot reproduction property and the dot transfer property of highlighted portions are significantly improved.

DESCRIPTION OF THE PREFERRED EMBODIMENT

A preferred embodiment of the present invention will be described hereinafter.

Examples of a substrate to be used in a recording material of the present invention include paper, plastic film, synthetic paper and the like. Paper which has been subjected to the smoothing treatment and/or the coating treatment is also acceptable. When the production is carried out by a wet setting method, paper which has been soaked in a resin or laminated with a resin so as to have water proof may be used.

The plastic film may include voids provided inside of the film or may be made opaque by adding a filler. Examples of such a plastic film include a plastic film provided with voids by kneading a filler such as calcium carbonate into a polyolefin resin, and synthetic paper provided with voids by kneading a filler such as titanium oxide, barium sulfate etc. into a polyester resin. The plastic film may be single-layered or multi-layered. In order to improve attaching property and wetting property, the corona-treatment, the attachment-facilitating treatment or the like may be subjected to the plastic film. The thickness of the substrate is 10 to 400 $\mu$m and preferably 12 to 250 $\mu$m.

The ink receiving layer of the recording material of the present invention contains, as main components, a resin and a pigment. The resin is used as an adhesive and for enhancing the affinity between the recording material and ink. The pigment is used for enhancing the opacity and the affinity with the ink.

Examples of the resin include an acrylic resin, a vinyl chloride resin, vinyl chloride-vinyl acetate copolymer, a polyester resin, ethylene-vinyl acetate copolymer, an urethane resin and a polyvinylbutyral resin. When the wet setting method is employed, a hydrophobic resin is preferable.

Examples of the pigment include organic or inorganic pigments such as titanium oxide, talc, calcined kaolin, clay, calcium carbonate, diatomaceous earth, aluminum hydroxide, silica, polystyrene and polymethacrylate. A slip-facilitating agent such as wax, silicon and/or a slip preventing agent such as silica may be added in order to adjust the friction coefficient. The particle diameter of the pigment is no larger than 6 $\mu$m and preferably no larger than 3 $\mu$m, in order to enhance the flatness of the ink receiving layer.

A defoaming agent, a surfactant, a plastizer or the like may be added in an appropriate manner, in addition to the resin and the pigment.

An anchor coating layer for increasing the attachment strength and/or an intermediate layer for increasing the cushioning property may be provided between the substrate and the ink receiving layer. In addition, in order to adjust the friction coefficient, a slip-facilitating layer containing wax, silicon etc. or a slip preventing layer containing silicon etc. may be provided on the opposite surface which faces the ink receiving layer, i.e., the back surface of the recording material.

The apparent density of the ink receiving layer is preferably 0.2 to 0.8 g/cm$^3$. Here, the apparent density is expressed by the following equation:

(Apparent density) (g/cm$^3$)=[(the basis weight of the recording material as a whole after coating: g/cm$^2$)−(the basis weight of the substrate: g/cm$^2$)]/(thickness of the ink receiving layer: cm).

When the apparent density of the ink receiving layer is smaller than 0.2 g/cm$^3$, the strength of the ink receiving layer may be insufficient. When the apparent density of the ink receiving layer is larger than 0.8 g/cm$^3$, the cushioning property and the heat insulating property may be insufficient, whereby the dot transfer in highlighted portions deteriorates.

Next, the heat conductivity of the ink receiving layer and the substrate is preferably 0.1 to 0.25 W/m·K. When the heat conductivity is smaller than 0.1 W/m·K, the heat insulating effect is too high and the heat release from the head is suppressed, whereby the ink may be transferred to non-printing portions, i.e., background stains. When the heat conductivity is larger than 0.25 W/m·K, the heat insulating effect is too low and the heat is released from the head too easily, whereby the dot transfer property at the highlighted portions where energy is relatively low may deteriorate.

The center line average roughness of the ink receiving layer surface is preferably 0.20 to 0.45 $\mu$m. The center line average roughness represents the flatness of the ink receiving layer surface. The flatter the ink receiving layer surface is, the more preferable as the image receiving paper for the melting type thermal transfer printing. This is conspicuous in the case in which a head of a printer is a line head having the same length as the width of the paper, because, if the ink receiving layer surface is not smooth, the attachment property of the ink receiving layer with the ink ribbon deteriorates, whereby ink melted by the heat generated at the head tends to cause troubles in transfer during the transfer process. In addition, in a printer of a smaller size in which printing pressure is relatively low, the flatness property of the ink receiving layer becomes a more important factor. When the center line average roughness is larger than 0.45 $\mu$m, the roughness of the ink receiving layer surface is significantly large and thus the transfer property of ink may deteriorate. When the center line average roughness is smaller than 0.20 $\mu$m, the transfer property of ink remains satisfactory but, in a case in which a plurality of sheets of the recording material is set in a stacked manner, the adjacent upper and lower sheets tend to stick to each other, thereby causing a transfer failure, which is not desirable.

Further, the average pore diameter of the ink receiving layer surface is preferably 0.05 to 1 $\mu$m. The average pore diameter is significantly correlated with the cushioning property and the transfer property of ink. When the average pore diameter is smaller than 0.05 $\mu$m, the individual void tends to be too small to effect satisfactory cushioning property. When the average pore diameter is larger than 1 $\mu$m, if a dot is provided right on a pore, the dot is not properly transferred onto the pore portion or the ink falls into the pore, whereby the dots at such portions are missing and the overall concentration is decreased.

The thickness of the ink receiving layer is 1 to 80 $\mu$m and preferably 5 to 50 $\mu$m. The thickness of the ink receiving layer is correlated with the rate of the apparent voids. When the ink receiving layer is too thick, release or vaporization of the solvent deteriorates, whereby the void rate is decreased. On the other hand, when the ink receiving layer is too thin, if the void rate is relatively large, the strength of the ink receiving layer may not be sufficient and the surface layer may be brittle.

When sheets of the recording material of the present invention are prepared in a stacked manner, the statical coefficient of friction observed between the ink receiving layer surface of one sheet and the back surface of another sheet is preferably 0.1 to 0.7 and more preferably 0.2 to 0.5. The statical coefficient of friction is correlated with transfer troubles such as more than two sheets altogether being transferred (overlapping transfer), failure in transfer, i.e., failure in feeding the recording material into a printer, and the like, when a plurality of sheets of the recording material is set in a cassette for paper supply. When the statical coefficient of friction is larger than 0.7, such overlapping transfer or failure in transfer as described above is more likely to occur. When the statical coefficient of friction is smaller than 0.1, the sheets of the recording material become too slippery, thereby disturbing the sheet-aligning operation after cutting or in packaging.

Next, the dynamical coefficient of friction is preferably 0.1 to 0.6. When the dynamical coefficient of friction is larger than 0.6, the sheets of the recording material do not slip on the paper-supply path properly and the transfer of sheets becomes intermittent, whereby the ink receiving layer may be scratched and lateral stripe patterns may appear in the resulted print. When the dynamical coefficient of friction is smaller than 0.1, the sheets of the recording material tend to slip in an inappropriate manner inside the printer, whereby misalignment of colors in multi-color printing is likely to occur.

The stiffness of the recording material is preferably 40 to 300 $cm^3$ and more preferably 80 to 250 $cm^3$ when the stiffness is measured according to JIS P 8143. When the stiffness is lower than 40 $cm^3$, wrinkles, bending, jamming tend to occur during transfer in a printer. When the stiffness is higher than 300 $cm^3$, the sheet of the recording material tends to tenaciously remain in a coiled-up state, whereby failure in transfer may be caused during the cutting process.

Various methods including the foaming method, the dry method, the wet setting method and the like can be employed in order to obtain the aforementioned density, heat conductivity, center line average roughness and average pore diameter. Among these methods, the wet setting method is the most preferable because sufficiently small-sized pores and excellent flatness of the ink receiving layer are easily obtained. The wet setting method includes the steps of: dissolving the resin in a solvent and coating the dissolved resin on the substrate; then immersing the substrate in a liquid to which the solvent is soluble but the resin is insoluble, to allow the resin coating to solidify; immersing the substrate in a hot bath at a temperature of no lower than 60° C. or preferably no lower than 80° C.; and drying the product. Dimethylformamide, for example, may be used as the solvent. As the liquid to which the resin is insoluble, water may be used.

Further, examples of the method of coating the ink receiving layer include known reverse roll coating, air knife coating, gravure coating, blade coating, comma coating and the like.

As described above, the recording material of the present invention obtained in the aforementioned manner is excellent in the cushioning property, the heat insulating property and the flatness of the surface layer. Therefore, generation of background stains and failure in transfer are prevented, the sufficient strength of the recording material is obtained and, in particular, the dot reproduction of highlighted portions are excellent, whereby images sufficiently comparable with silver salt photographs are obtained. In addition, failure in transfer is reliably prevented when paper is supplied by the cassette-employing method.

Next, Examples and Comparative Examples of the recording material of the present invention will be described hereinafter. In the following description, "parts" represents "parts by weight" and "%" represents "weight %".

EXAMPLE 1

A white PET film having thickness of 100 μm ("Melinex 339", manufactured by Teijin-Du Pont Co.) was prepared as a substrate. After subjecting one surface of the PET film to the anchor coating treatment of the following composition 1, the coating solution of the following composition 2 was coated on the one surface of the PET film. The product was immersed in a water tank for one minute and then immersed for 5 seconds in hot water at the temperature of 90° C. Thereafter, moisture was removed by drying, whereby an ink receiving layer having coating thickness of 30 μm was formed.

[Composition 1]

| | |
|---|---|
| Acrylic resin ("Acronal YJ-2721D", solid content 46%, manufactured by BASF Dispersion Co.) | 37 parts |
| Water | 59 parts |
| Silica ("Mizukasil P-801", manufactured by Mizusawa Industrial Chemicals, Ltd.) | 2 parts |
| Wetting agent ("SN Wet 366", manufactured by San Nopco Ltd..) | 1 parts |
| Defoaming Agent ("SN Deformer 480", manufactured by San Nopco Ltd..) | 0.02 parts |

[Composition 2]

| | |
|---|---|
| Dimethylformamide | 67 parts |
| Vinyl chloride-vinyl acetate copolymer resin ("Solbin C", manufactured by Nissin Chemical Industry Co., Ltd.) | 18 parts |
| Calcium carbonate (Light-weight calcium carbonate, average particular diameter of 2 μm, manufactured by Maruo Calcium Co., Ltd.) | 11 parts |
| Hydrophobic silica ("Aerosil R-972", average particle diameter 16 nm, manufactured by Nippon Aerosil) | 4 parts |

EXAMPLE 2

A white PET film having thickness of 50 μm ("Melinex 339", manufactured by Du Pont Co.) was prepared as a substrate. After subjecting one surface of the PET film to the anchor coating treatment of the aforementioned composition 1, the coating solution of the aforementioned composition 2 was coated on the one surface of the PET film. The product was immersed in a water tank for one minute and then immersed for 5 seconds in hot water at the temperature of 90° C. Thereafter, moisture was removed by drying, whereby an ink receiving layer having coating thickness of 30 μm was formed. An adhesive layer and a peeling paper as seal paper were provided on the other surface of the substrate opposite, which was opposite to the ink receiving layer.

COMPARATIVE EXAMPLE 1

A white PET film having thickness of 100 μm ("Melinex 339", manufactured by Teijin-Du Pont Co.) was prepared as a substrate. After subjecting one surface of the PET film to the anchor coating treatment of the aforementioned composition 1, the coating solution of the following composition 4 was coated on the one surface of the PET film. The product was immersed in a water tank for one minute and then immersed for 5 seconds in hot water at the temperature of 90° C. Thereafter, moisture was removed by drying, whereby an ink receiving layer having coating thickness of 30 μm was formed.

[Composition 4]

| | |
|---|---|
| Dimethylformamide | 67 parts |
| Vinyl chloride-vinyl acetate copolymer resin ("Solbin C", manufactured by Nissin Chemical Industry Co., Ltd.) | 18 parts |
| Calcium carbonate (Light-weight calcium carbonate, average particular diameter of 2 μm, manufactured by Maruo Calcium Co., Ltd.) | 11 parts |
| Silica ("Mizukasil P-78D, average particle diameter 9 nm, manufactured by Mizusawa Industrial Chemicals, Ltd.) | 4 parts |

COMPARATIVE EXAMPLE 2

A white PET film having thickness of 100 μm ("Merinex 339", manufactured by Teijin-Du Pont Co.) was prepared as a substrate. After subjecting one surface of the PET film to the anchor coating treatment of the aforementioned composition 1, the coating solution of the following composition 5 was coated on the one surface of the PET film. The product was immersed in a water tank for one minute and then immersed for 5 seconds in hot water at the temperature of 90° C. Thereafter, moisture was removed by drying, whereby an ink receiving layer having coating thickness of 30 μm was formed.

[Composition 5]

| | |
|---|---|
| Dimethylformamide | 54 parts |
| Acrylonitryl-styrene resin ("Toyo AS61", manufactured by Toyo Styrene Co.) | 16 parts |
| Calcium carbonate (Light-weight calcium carbonate, average particular diameter of 2 μm, manufactured by Maruo Calcium Co., Ltd.) | 25 parts |
| Titanium oxide ("TIPAQUE R-820", average particle diameter 0.4 μm, manufactured by Ishihara Sangyo Co.) | 3 parts |
| Plasticizer ("DOA", manufactured by Sanken Kako Co.) | 2 parts |

EXAMPLE 3

A foamed polypropylene film having thickness of 130 μm ("Yupo FPG#130", manufactured by Oji Yuka Goseishi Co.) was prepared as a substrate. After subjecting one surface of the film to the anchor coating treatment of the aforementioned composition 1, the coating solution of the following composition 6 was coated on the one surface of the PET film. The product was immersed in a water tank for one minute and then immersed for 5 seconds in hot water at the temperature of 90° C. Thereafter, moisture was removed by drying, whereby an ink receiving layer having coating thickness of 30 μm was formed.

[Composition 6]

| | |
|---|---|
| Dimethylformamide | 78 parts |
| Polyacrylonitrile resin ("Beslon W241", manufactured by Toho Textile Co.) | 6 parts |
| Polyvinylbutyral resin ("ESLECK BM-S", manufactured by Sekisui Chemicals Co., Ltd.) | 3 parts |
| Vinyl chloride-vinyl acetate copolymer resin ("Solbin C", manufactured by Nissin Chemical Industry Co., Ltd.) | 13 parts |

For each of the recording materials obtained by the aforementioned Examples 1 to 3 and Comparative Examples 1 and 2, the characteristics thereof was measured by the following method.

Specifically, the heat conductivity was measured by a rapid heat conductivity meter "QTM-500" manufactured by Kyoto Denshi Kogyo Co., by using a software for measuring a thin film. The center line average roughness was measured by a laser focus displacement meter "LT-8100" manufactured by Keyence Co., according to JIS B 0601. The average pore diameter was measured by photographing the ink receiving layer surface by an electron microscope and then measuring the diameters of pores in the photograph. The coefficients of friction were measured by using a friction measuring device "TR-2 type" manufactured by Toyo Seiki Seisakusho Co., according to JIS P 8147. The stiffness was measured by using a Clark stiffness tester manufactured by Toyo Seiki Seisakusho Co., according to JIS P 8143. The measurement results are shown in Table 1.

[Table 1]

For each of the recording materials obtained by the aforementioned Examples 1 to 3 and Comparative Examples 1 and 2, the printing property thereof was evaluated by first photographing the test patterns by a digital video camera "Viewcam" (VL-FD1) manufactured by SHARP Co., and then printing, for evaluations on the card print base. Specifically, with respect to the transfer property of highlighted portions, dots in the 12.5% concentration portion of C (cyan) were observed with a stereomicroscope for evaluation by human eyes. With respect to the dot shapes, the dot shapes of 12.5%, 25%, 37.5% , and 50% concentration portions of C (cyan) were observed by a stereomicroscope for evaluation by human eyes. With respect to the concentration of the 100% printed portion, the 100% printed portion of C (cyan) was measured by a Macbeth concentration meter RD-918. The results of the aforementioned evaluations are shown in Table 2.

[Table 2]

TABLE 1

| | Apparent density ($g/cm^3$) | Heat conductivity ($W/m \cdot K$) | Center line average roughness (μm) | Average pore diameter (μm) | Statical friction coefficient | Dynamical friction coefficient | Handling Stiffness ($cm^3$) |
|---|---|---|---|---|---|---|---|
| Example 1 | 0.55 | 0.22 | 0.30 | 0.2 | 0.65 | 0.50 | 54 |
| Example 2 | 0.55 | 0.21 | 0.30 | 0.2 | 0.62 | 0.48 | 48 |
| Example 3 | 0.38 | 0.19 | 0.31 | 5.0 | 0.55 | 0.43 | 100 |
| Comparative Example 1 | 0.63 | 0.18 | 0.57 | 0.8 | 0.72 | 0.61 | 55 |
| Comparative Example 2 | 0.86 | 0.29 | 0.37 | 0.7 | 0.56 | 0.40 | 60 |

TABLE 2

| | Transfer property of highlighted portions | Dot shapes | Concentration of 100% printed portion |
|---|---|---|---|
| Example 1 | ○ | ○ | ◎ |
| Example 2 | ○ | ○ | ◎ |
| Example 3 | Δ | Δ | ○ |
| Comparative Example 1 | X | X | Δ |
| Comparative Example 2 | X | X | ○ |

What is claimed is:

1. A recording material in which an ink receiving layer containing at least a resin and a pigment is provided on a substrate characterized in that the ink receiving layer is porous, apparent density thereof is between 0.5 and 0.8 g/cm$^3$ and heat conductivity of the ink receiving layer and the substrate is 0.1 to 0.25 W/mK, wherein statical coefficient of friction observed between the ink receiving layer surface and the recording material back surface is 0.1 to 0.7, dynamical coefficient of friction observed between the ink receiving layer surface and the recording material back surface is 0.1 to 0.6 and the stiffness of the recording material in the longitudinal direction thereof is 40 to 300 cm$^3$ when measured according to JIS P 8143.

2. A recording material of claim 1, wherein the average pore diameter of the surface layer of the ink receiving layer is 0.05 to 1 $\mu$m.

3. A recording material of claim 1, wherein center line average roughness of the ink receiving layer surface is 0.20 to 0.45 $\mu$m.

4. A recording material of claim 3 wherein the average pore diameter of the surface layer of the ink receiving layer is 0.05 to 1 $\mu$m.

5. A recording material in which an ink receiving layer containing at least a resin and a pigment is provided on a substrate characterized in that the ink receiving layer is porous, apparent density thereof is 0.2 to 0.8 g/cm$^3$ and center line average roughness of the ink receiving layer surface is 0.20 to 0.45 $\mu$m wherein statical coefficient of friction observed between the ink receiving layer surface and the recording material back surface is 0.1 to 0.7, dynamical coefficient of friction observed between the ink receiving layer surface and the recording material back surface is 0.1 to 0.6 and the stiffness of the recording material in the longitudinal direction thereof is 40 to 300 cm$^3$ when measured according to JIS P 8143.

6. A recording material of claim 5, wherein the average pore diameter of the surface layer of the ink receiving layer is 0.05 to 1 $\mu$m.

* * * * *